US006379534B1

(12) United States Patent
Fung et al.

(10) Patent No.: US 6,379,534 B1
(45) Date of Patent: Apr. 30, 2002

(54) POUR POINT DEPRESSION UNIT USING MILD THERMAL CRACKER

(75) Inventors: Gee S. Fung; Philip E. DePalm; Puneet Sharma, all of Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/252,760

(22) Filed: Feb. 19, 1999

(51) Int. Cl.[7] ..... C10G 7/00; C10G 9/00; C10G 9/14

(52) U.S. Cl. ..... 208/93; 208/92; 208/106; 208/131; 208/132

(58) Field of Search ..... 208/24, 92, 93, 208/106, 131, 132

(56) References Cited

U.S. PATENT DOCUMENTS 3,767,564 A * 10/1973 Youngblood et al. ..... 208/92
3,900,391 A * 8/1975 Merrill, Jr. et al. ..... 208/370

* cited by examiner

*Primary Examiner*—Walter D. Griffin
*Assistant Examiner*—Tam M. Nguyen
(74) *Attorney, Agent, or Firm*—Conley, Rose & Tayon, P.C.

(57) ABSTRACT

A method for lowering the cloud/pour point of a waxy crude oil in locations where size and/or weight of the facility may need to be limited (i.e. arctic zones and offshore). The major components of the system comprise a fractionation/quench tower and a reaction furnace. The furnace has sufficient heat input to initiate thermal cracking of wax and the fractionation tower is operated at a temperature sufficient to flash off light hydrocarbons but also low enough to quench thermal cracking reaction. The feed to the furnace comprises a portion of the bottoms stream from the tower and the furnace output is fed back into the tower bottom to be quenched.

9 Claims, 1 Drawing Sheet

POUR POINT DEPRESSION UNIT USING MILD THERMAL CRACKER

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates generally to techniques for treating crude oil prior to transporting it, and more particularly, to a method and apparatus for reducing the pour point of the crude. Still more particularly, the present invention relates to a system for thermally cracking the high boiling components of the crude so as to provide a processed crude that can withstand extended periods at temperatures below the cloud point of the raw crude without suffering from wax formation.

BACKGROUND OF THE INVENTION

As drilling for oil is performed in harsher locations (i.e. deep water, arctic regions, regions with limited infrastructure, etc.), or far from a host-facility the expense associated with transporting the crude oil from the wellhead to a receiving facility increases significantly. Pipelines and tankers are two common means for transporting crude over long distances. In the case of offshore wells, the pipelines lie on the sea floor, where the ambient temperatures can be relatively low (i.e. 35–45° F.). Similarly, some overland pipelines, such as those in the arctic, may also be at relatively low ambient temperatures. One disadvantage of transporting crude oil at low temperatures is that certain crudes may contain a significant quantity of wax. As used herein, the term "wax" refers to and encompasses various high boiling, high molecular weight paraffinic hydrocarbons that gel or solidify at relatively high temperatures. When these compounds are present in a liquid, the temperature at which these compounds begin to solidify is referred to as the "cloud point" or wax appearance temperature of that liquid. The temperature at which the wax gels is referred to as the "pour point". In instances where the cloud point of a waxy crude is higher than the local ambient temperature, the likelihood of wax solidification and buildup is a serious threat to a stable continuous production and transportation of crude oil.

For this reason, waxy, high-pour crude oils are known to have poor pipeline flow characteristics. In addition, they exhibit a tendency to gel at temperatures encountered during transportation. This tendency is particularly troublesome when a pipeline containing these crudes is shut down under low ambient temperatures. Clearing a pipeline that has become clogged with wax or gelled crude can be very expensive and time-consuming.

A number of processes have been suggested in the art for dealing with such flow problems. For example, the pour points of waxy crudes have been improved (lowered) by the removal of a part of the wax by solvent extraction at low temperatures, with the attendant expense of recovering the solvent. In addition, the expenses associated with disposing of the wax and providing the cooling requirements are substantial, particularly in offshore applications. In other known processes, wax is removed without the use of a solvent by centrifuging a previously heated crude that has been cooled at a critically controlled and slow rate to a centrifuging temperature of around 35°–55° F.

Another widely practiced process involves diluting the waxy crudes with lighter fractions of hydrocarbons. This process suffers from a number of disadvantages, including the fact that the procedure involves the use of relatively large amounts of expensive hydrocarbon solvents to transport a relatively cheaper product. Furthermore, this practice also necessarily requires that the hydrocarbon solvents be available in suitable quantities, which is inconvenient in some instances, particularly offshore and in remote locations.

In another method, heating equipment installed along the pipeline at frequent intervals warms the crude and maintains it above the pour and possibly above the cloud point. Heaters employed for this purpose can use material withdrawn from the crudes being transported as fuel, but as much as 5 percent of the crude may be utilized in providing the necessary heat. Most pipelines are not equipped with such heating installations, however, and the installation of the necessary heating equipment may be economically unfeasible. In addition, when the crude is burned to provide heat, pollution concerns and treatment of the combustion exhaust gases may have to be addressed.

Hence, it is desired to provide an efficient and economically viable method and apparatus for reducing the pour point of the crude before subjecting it to low-temperature transport. It is further desired to provide a dewaxing method and apparatus that are not dependent on large volumes of solvents or other chemicals and is limited in weight and size to ensure ease of installation and favorable economics.

BRIEF SUMMARY OF THE INVENTION

The present invention provides an efficient and economically feasible method for reducing the pour point of a crude before transporting it. According to the present invention, the crude is thermally cracked so as to reduce or eliminate waxy paraffin molecules by converting them to non-waxy hydrocarbons.. The present invention comprises a system including a fractionation/quench tower, heat exchanger, and furnace with reaction zone. The fractionation tower separates the waxy paraffin molecules that are the object of the process from the incoming crude stream. In the furnace, sufficient heat is supplied to these waxy paraffin molecules to initiate thermal cracking. Because thermal cracking is an exothermic process, once cracking is initiated, it continues until the stream is cooled below a minimum sustainable cracking temperature. In order to quench the stream and cool it below this minimum temperature, the stream is fed back into the bottom of the fractionation tower.

BRIEF DESCRIPTION OF THE DRAWING

Other objects and advantages of the invention will become apparent upon reading the following detailed description and upon reference to the accompanying drawing in which.

DETAILED DESCRIPTION OF A PREFERRED EMBODIMENT

Figure 1:
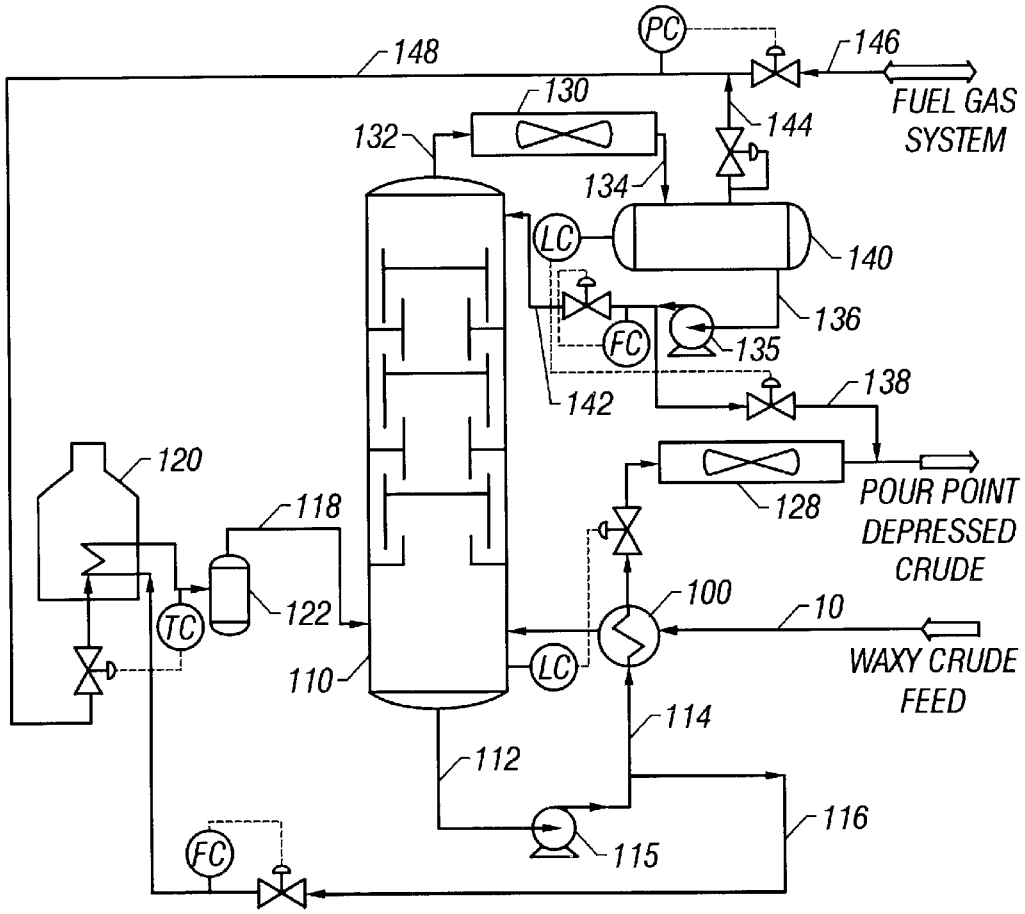
FIG. 1 is a schematic diagram of a preferred embodiment of the present apparatus.

As illustrated schematically in FIG. 1, a preferred embodiment of the present system for lowering the pour point of a crude feed stream comprises a fractionation tower 110 and a furnace 120, along with a preferred combination of heat exchangers 100, 128 and 130 that are configured as described in detail below. More specifically, the waxy crude feed stream enters the system via feed line 10 and is warmed in heat exchanger 100 through thermal contact with a stream leaving the system, as described below. The warmed feed enters fractionation tower 110 at one of the lower trays. In the tower, the lighter components of the crude feed vaporize and flow to the top of tower 110. The liquids that do not vaporize in tower 110 exit via line 112 and are pumped downstream by pump 115. Downstream of pump 115, line 112 splits into an export line 114 and a recycle line 116.

The processed crude in line 116 is cycled to furnace 120, where it is heated to a temperature sufficient to break down the waxy paraffin molecules. The waxy paraffin molecules are thermally cracked into smaller hydrocarbon molecules, which have lower pour points and thus have less tendency to form waxy solids when cooled. Thermal cracking is an exothermic process that requires an activation energy. Furnace 120 serves to provide the activation energy to the high-boiling fraction of the crude, by heating it to a temperature at which thermal cracking becomes self-sustaining. Because the cracking process gives off energy, however, once it has begun, there is a tendency for the reaction to run away, as the heat given off accelerates the reaction.

According to the present invention, the temperature of the crude fraction in furnace 120 is prevented from exceeding a certain predetermined value. The cracking reaction is allowed to continue until this target temperature is reached, whereupon the hot crude is quenched by feeding it into the bottom of fractionation tower 110 via line 118. In one preferred embodiment, an optional reaction drum 122 is provided between furnace 120 and tower 110 and the flow rate therethrough is adjusted, so that the crude stream is maintained at the cracking temperature for a predetermined residence time. From furnace 120 or drum 122, the cracked crude in line 118 enters fractionation tower 110, preferably at a point near the bottom of the tower. Upon entering fractionation tower 110, some of the newly-created lower-boiling compounds evaporate and leave the top of the tower. The balance of the cracked crude mingles with the incoming stream 10 and again exits tower 110 via line 112. From line 112, the processed crude that is not recycled to furnace 120 passes via line 114 through heat exchanger 110, where it is cooled through thermal contact with the incoming feed stream 10. From heat exchanger 110, the product in line 114 is cooled further in heat exchanger 128, blended with liquids condensed from the tower overheads (described below), and sent to storage and/or export. Hence, the bottoms of tower 110 comprise a recirculating stream that is continually cycled through the furnace. The cycling stream is continuously fed with fresh waxy crude and continuously provides low boiling compounds to the tower overhead and processed crude for export via line 114. The relative amounts of processed crude flowing through lines 114 and 116 can be altered and controlled to achieve a desired degree of cloud/pour point reduction. In one preferred embodiment, the volume ratio of stream 116 to stream 112 is at least 40% and more preferably at least 50%. In addition, the stream of processed crude in line 112 can be split either before or after heat exchanger 100, depending on the desired amount of heat recovery.

The vapors evaporated from the stream in tower 110 traverse up the column and eventually exit through its top to an overhead cooler 130 via line 132. The heavier molecules in the vapor condense in cooler 130 and are captured in condensation drum 140. A portion of the liquids collected in condensation drum 140 are recycled back to the fractionation tower via pump 135 and line 142. A second portion of the liquids collected in condensation drum 140 are mixed via line 138 with the processed crude product in line 114 prior to shipping or storage. The gaseous compounds remaining in condensation drum 140 exit from the top of the drum 140 via line 148 and may be used as fuel for furnace 120. If furnace 120 does not consume all of the fuel gas, the remainder of the gas is exported or disposed of via line 146.

The specifications and preferred operating parameters for a one preferred system are set out in Table 1 below. It will be understood that these specifications are illustrative only, and do not limit the scope of the invention.

TABLE 1

| Ref. No. | Item | Purpose | Operating Parameters |
|---|---|---|---|
| 100 | Heat Exchanger | Cool Bottoms/Preheat Waxy Feed | 150 psig at 350° F./ 150 psig at 650° F. (Shell/Tube) |
| 110 | Distillation Column with Dual Pass Valve Trays | Separating High-Boiling and Low-Boiling Compounds | 150 psig at 150° F./ 150 psig at 650° F. (Top/Bottom) |
| 115 | Centrifugal Pump | Bottoms Pump | 150 psig at 650° F. |
| 120 | Gas Fired Natural Draft Furnace with Vertical Cabin | Cracking Waxy Compounds | 150 psig at 950° F. (Tubes) Furnace lined with 1.0% chrome and 0.5% molybdenum alloy |
| 122 | Vessel | Increasing Reaction Residence Time | 150 psig at 950° F., lined with 1.0% chrome and 0.5% molybdenum alloy |
| 128 | Shell & Tube Heat Exchanger | Condensing Bottoms Product | 150 psig at 550° F. (Tube) |
| 130 | Shell & Tube Heat Exchanger | Condensing Overhead Reflux | 150 psig at 250° F. (Tube) |
| 135 | Centrifugal Pump | Overhead Pump | 150 psig at 150° F. |
| 140 | Vessel | Overhead Condenser/ Reflux Drum | 150 psig at 150° F. |

In addition to the preferred operating parameters, certain parameters of the components in the present system are adjusted, depending on the composition of the waxy crude feed. Table 2 below gives exemplary values for temperature and pressure at various points in the systems for a feed comprising a 35% API gravity crude with a 10% wax content. It will be understood that these values are illustrative only, and do not limit the scope of the invention because, for each crude feed, there will be a different effective/optimum operating range of temperatures and pressures. For example, if the temperature in the fractionation tower is too high, too much of the stream will exit the top of the tower. If the temperature in the tower is too low, too much of the stream will exit the bottom of the tower. If the temperature in the furnace is too high, coking may occur, and if the temperature in the furnace is too low, cracking will not occur. The effective operating ranges will be discernable to those skilled in the art.

TABLE 2

| Reference Numeral | Variable | Approximate Target Value |
|---|---|---|
| 110 | Fractionation Tower Bottoms Temperature | 600° F. |
| 120 | Furnace Temperature | 900° F. |
| 116:112 | Recycle Rate to Furnace | 50% |
| 122 | Residence Time in Reaction Drum | 1–3 minutes |

Because the present method and apparatus can be used offshore to produce a low-boiling crude, the streams produced in this manner can be used to flush pipelines that have become clogged with wax. The processed crude generated in the present system can act as a solvent on the waxy buildup in the clogged pipelines. Also in the event of facility shut-down the solvent may be used to displace the waxy crude in the incoming feed flowline (i.e. pipeline from the well-head) or storage. This flushing exercise may be necessary if the shut-down is of a considerable duration.

While a preferred embodiment of the present system has been described in terms of a continuous process, it will be understood that the present system could alternatively be operated in a batch mode. Likewise, one skilled in the art will understand that the various components of the present system can be modified or rearranged so as to alter various parameters within the system, without departing from the scope of the invention. For example, the relative proportions of each stream that are diverted or split can be varied. Likewise, the temperatures and pressures at which the various steps of the invention are carried out can be varied, so long as the objective of lowering the pour or cloud point of the waxy crude feed is accomplished. It is similarly contemplated, although not preferred, that any of the heat exchangers disclosed herein could be replaced with alternative equipment for heating and cooling the respective streams.

The present system is particularly suitable for offshore applications, as it allows the use of a much smaller furnace. Because of the relatively high rate of recycle and optimization, furnace 120 can be reduced in size and in some instances reaction drum 122 may be eliminated. The disadvantage normally associated with operating in this mode is mitigated by the ready availability of fuel, i.e. uncondensed tower gases that may otherwise be a waste product. This system also provides an effective alternative to conventional offshore crude stabilization techniques since this process also provides a stabilized crude.

What is claimed is:

1. A method for lowering the pour point of a crude feed containing wax, comprising:

separating the crude feed in a fractionation tower so as to separate the crude into low-boiling and high-boiling fractions;

thermally cracking a first portion of the high-boiling fraction in a furnace and cycling the cracked first portion back into the fractionation tower so as to quench the thermal cracking reaction;

exporting a second portion of the high-boiling fraction as an export stream;

recovering the low-boiling fraction from the top of the tower;

burning a first portion of the recovered low-boiling fraction in the furnace so as to supply sufficient heat to the first portion in the furnace to initiate thermal cracking of the wax;

condensing a second portion of the recovered low-boiling fraction to form a condensed stream;

blending a first part of the condensed stream into the export stream; and feeding a second part of the condensed stream into the fractionation tower wherein the pour point of the export stream is controlled by:

(i) controlling the length of time that the cycled portion of the high-boiling fraction is maintained at thermal cracking conditions; and (ii) controlling the relative amounts of the first and second portions of the high-boiling fraction.

2. The method according to claim 1 wherein the temperature in the fractionation tower is lower than the temperature in the furnace, such that when the first portion re-enters the furnace it is quenched below the thermal cracking temperature of the wax.

3. A method for lowering the pour point of a crude feed containing wax so as to generate a transportable export stream, comprising:

(a) separating the crude feed in a fractionation tower so as to separate the crude into low-boiling and high-boiling fractions;

(b) cycling a first portion of the high-boiling fraction through a furnace and maintaining the first portion of the high-boiling fraction at a temperature sufficient to promote thermal cracking and for a time period sufficient to obtain a desired degree of thermal cracking;

(c) returning the thermally cracked portion back into the fractionation tower so as to quench the thermal cracking reaction;

(d) exporting a second portion of the high-boiling fraction as an export stream;

(e) feeding a first portion of the low-boiling fraction into the furnace as fuel;

(f) condensing a second portion of the low-boiling fraction and blending a first portion of the condensed second portion with the export stream; and (g) controlling the pour point of the export stream by:

(i) controlling the length of time that the cycled portion of the high-boiling fraction is maintained at thermal cracking conditions; and (ii) controlling the relative amounts of the first and second portions of the high-boiling fraction.

4. The method according to claim 3 wherein the temperature in the fractionation tower is lower than the thermal cracking temperature of the wax such that when the first portion re-enters the furnace it is quenched below the thermal cracking temperature of the wax.

5. The method according to claim 3, further including the step of recovering the low-boiling fraction from the top of the tower.

6. The method according to claim 3, further including the step of feeding a second portion of the condensed second portion of the low-boiling fraction into the fractionation tower.

7. A method for lowering the pour point of a crude feed containing wax, comprising:

(a) separating the crude feed in a fractionation tower so as to separate the crude into low-boiling and high-boiling fractions;

(b) recovering the low-boiling fraction from the top of the tower;

(c) condensing a first portion of the low-boiling fraction to form a condensed stream;

(d) cycling a first portion of the high-boiling fraction through a furnace in which thermal cracking occurs and back into the fractionation tower so as to quench the thermal cracking reaction and exporting a second portion of the high-boiling fraction as an export stream;

(e) blending a first portion of the condensed stream into the export stream;

(f) feeding a second portion of the low-boiling fraction into the furnace as fuel; and (g) supplying sufficient heat to the furnace to initiate thermal cracking of the wax;

wherein the pour point of the export stream is controlled by:

(i) controlling the length of time that the cycled portion of the high-boiling fraction is maintained at thermal cracking conditions; and (ii) controlling the relative amounts of the first and second portions of the high-boiling fraction.

8. The method according to claim 5 wherein the temperature in the fractionation tower is lower than the thermal cracking temperature of the wax, such that when the first portion re-enters the furnace it is quenched below the thermal cracking temperature of the wax.

9. The method according to claim 7, further including the step of feeding a second portion of the condensed stream into the fractionation tower.

* * * * *